United States Patent [19]

Yamada et al.

[11] Patent Number: 4,556,873

[45] Date of Patent: Dec. 3, 1985

[54] FIRE ALARM SYSTEM

[75] Inventors: Kiyoshi Yamada, Mie; Kazumasa Murakami, Aichi, both of Japan

[73] Assignee: Matsushita Electric Works, Ltd., Osaka, Japan

[21] Appl. No.: 602,749

[22] Filed: Apr. 23, 1984

[30] Foreign Application Priority Data

Apr. 30, 1983 [JP] Japan ..... 58-76826

[51] Int. Cl.[4] ..... G08B 17/10

[52] U.S. Cl. ..... 340/630; 250/574; 340/511

[58] Field of Search ..... 340/628, 630, 514, 515, 340/516, 629, 511; 250/573, 574, 575, 381; 356/439

[56] References Cited

U.S. PATENT DOCUMENTS

| | | | |
|---|---|---|---|
| 4,254,414 | 3/1981 | Street et al. | 340/628 X |
| 4,308,430 | 12/1981 | Fahey et al. | 340/516 X |
| 4,388,616 | 6/1983 | Machida | 340/628 X |
| 4,447,801 | 5/1984 | Masuda | 340/516 X |
| 4,451,822 | 5/1984 | Verse et al. | 340/516 X |

*Primary Examiner*—James L. Rowland
*Assistant Examiner*—Daniel Myer
*Attorney, Agent, or Firm*—Stevens, Davis, Miller & Mosher

[57] ABSTRACT

A novel fire alarm system with a plurality of smoke detectors which are adapted to be installed in different locations are connected through a data transmission line to a receiver where the smoke density signals transmitted from the respective smoke detectors and indicative of the density of smoke in the corresponding locations are processed for determination of fire presence. The receiver is provided with fire judging circuit which identifies the presence of fire only when the smoke density detected by any one of the smoke detectors exceeds a reference density level and when such smoke density lasts over a reference time period. Thus, the information from each smoke detector is analyzed with respect to the smoke density and the time period over which the smoke density of significant level lasts. Accordingly, a reliable detection of fire is effectuated. Also incorporated in the system is a selector by which said reference density level can be selected from a plurality of predetermined density levels of different values and by which the reference time period can be selected from a plurality of predetermined time periods of different values. Consequently, the criterion which is the combination of the smoke density and the related time period for determination of fire presence can be variably set depending upon the differing conditions of the locations under surveillance, enabling the system to be easily and successfully adapted for use in different fire monitoring conditions.

10 Claims, 19 Drawing Figures

FIRE ALARM SYSTEM

BACKGROUND OF THE DISCLOSURE

1. Field of the Invention

The present invention is directed to a fire alarm system, and more particularly to a fire alarm system in which a receiver receives the information of the smoke density detected at each smoke detector to produce an alarm signal when the smoke density of significant level lasts over a predetermined reference time period.

2. Description of the Prior Art

There has been proposed a variety of fire alarm systems utilizing a plurality of smoke detectors to be installed in different locations for monitoring the smoke density indicative of fire presence or absence in each location. Such systems have been generally designed to produce an alarm when any one of the smoke detectors sees a serious smoke density. However, in these systems, only the smoke density is utilized as a criterion for determining fire presence or absence as well as a fixed reference smoke density is utilized as the criterion, which frequently results in a false fire detection as in the case when the smoke detector or detectors are installed in those rooms where there is frequent smoking or use of cooking appliances. To make matters worse, in the case that the smoke detector is adapted to operate fire prevention equipment such as a fire door, fire extinguisher and smoke ejector upon the detection of smoke density exceeding the reference density, the false detection of fire will require restoring the equipment to its initial condition. This actuation of the fire equipment by mistake or due to false fire detection is most disadvantageous when occurring at night. But unfortunately, in the prior art there is no effective scheme for preventing the malfunction at night other than disconnecting the operation of the system at night, which would therefore be no more effective for true fire occurrence at night and be very dangerous.

SUMMARY OF THE INVENTION

The present invention eliminates the above shortcomings and disadvantages and to provides an effective and useful fire alarm system available in different conditions. A fire alarm system in accordance with the present invention comprises: a receiver or central controller unit to which a plurality of smoke detectors are connected through a data transmission line to be installed in different remote locations. Each smoke detector measures the density of smoke in its corresponding location as analog data and transmits a smoke density digital signal indicative of the smoke density to the receiver. Included in the receiver is fire judging means which responds to the individual smoke density signals from the various smoke detectors for determining fire presence and fire location in such a manner that it identifies the presence of fire with respect to each smoke detector only when the smoke density detected by that smoke detector exceeds a reference density level and at the same time when such smoke density lasts over a reference time period. On the side of the receiver, there is provided selection means by which said reference smoke density can be selected among a plurality of different predetermined density levels and by which said reference time period can be selected among a plurality of predetermined time periods of different values. Alarm means is incorporated in the system for issuing an alarm signal in response to the above determination of fire presence. With this arrangement of adopting the smoke density together with the time period over which the smoke density of significant level lasts as the criterion for determining fire presence, more reliable detection of fire presence can be effectuated. In addition, both the reference smoke density and reference time period can be selected from the plurality of predetermined smoke density levels and from the plurality of predetermined time period values, respectively, whereby a suitable or proper criterion which is the combination of the smoke density with the time period can be set for successfully monitoring the locations or rooms of different conditions.

Accordingly, it is a primary object of the present invention to provide a fire alarm system which is reliable and can be easily adapted for monitoring locations of different conditions.

In a preferred embodiment of the present invention, fire responsive sensitivity shifting means is employed for adding extra performance to the above system. The fire responsive sensitivity shifting means comes into operation, upon the determination of fire presence in any one of the discrete locations by said fire judging means, for automatically increasing the sensitivity of the system against the density signals from the smoke detectors in other locations in determination of fire presence in the other locations by shifting either or both of the density and time period references for each of the smoke density signals from the smoke detectors. The receiver is ready for early detection of the progress and spread of fires or the direction of additional fires so as to assure rapid fire fighting, enabling personnel in charge of the fire to promptly take steps for checking the spread of fires as soon as possible and to maintain the damage at minimum.

It is therefore another object of the present invention is to provide a fire alarm system capable of pursuing promptly the spread of fires in an effective manner as to check the spread of fires.

A further advantageous feature attained in the present invention resides in the employment of a timer in combination with timer responsive sensitivity shifting means. The timer responsive sensitivity shifting means is designed to shift the sensitivity of the system against the smoke density signal transmitted from the smoke detectors by shifting either or both of said smoke density and time period references upon receiving the input from the timer. The functional relationship between the timer and the timer responsive sensitivity shifting means is such that said sensitivity is set to be lower in daytime where there may be frequent smoking or the use of cooking appliances than at night when there is no such smoke source. This prevents the system from false alarms due to smoking or cooking in daytime, while retaining a reliable fire detection at night.

It is therefore a further object of the present invention to provide a fire alarm system which can be automatically set to be in effective operating conditions during daytime and nighttime without relying upon annoying manipulation by the user.

One or more of said smoke detectors can be operatively associated with fire prevention equipments such as fire shutters, fire extinguishers and smoke ejectors. The fire prevention equipments can be actuated when said fire judging means determines the presence of fires in locations where the associated smoke detectors is installed. The present invention can also care for such fire prevention equipment and has means for properly actuating the equipment in response to the determination of the presence of a fire. For this purpose, said receiver includes associate sensitivity shifting means which decreases the sensitivity of the system to the smoke density signals transmitted from smoke detectors directly related to said fire prevention equipment as opposed to the smoke density signals from smoke detectors not directly related to the fire prevention equipment. The above automated decrease in the sensitivity takes effect in accordance with the instruction at an input device such as a keyboard provided on the receiver assigning one or more of the smoke detectors as associated with the fire prevention equipments. This arrangement ensures that the fire prevention equipment is less susceptible to a premature action which would result a false alarm due to smoking or the like.

It is therefore a still further object of the present invention to provide a fire alarm system which is capable of being programmed to cooperate with the fire prevention equipment so as to prevent the premature actuation of the fire prevention equipments.

For precautionary purpose, pre-alarm means is incorporated in the system for issuing a pre-alarm signal. When the smoke density from any one of the smoke detectors exceeds a sub-reference level which is lower than said reference level and such smoke density lasts over another predetermined time period, or when the time periods in each of which the smoke density from any one of the smoke detectors exceeds said reference smoke density total more than a certain predetermined value, the pre-alarm means responds to issue a pre-alarm or precautionary signal for early warning of fire. Thus, the pre-alarm means can monitor the outbreak of fire at an initial stage which can be determined by the smoke density being continuously above a lower level, or by the smoke density increasing intermittently above a higher level. This enables the system to early and accurately detect fires without fail, which is a still more object of the present invention.

In the present invention, there are disclosed further unique and useful arrangements for the fire alarm system. One is the introduction of ANDed fire alarm means which actuates said alarm means to produce the alarm signal only when said fire judging means determines fire presence for the respective smoke density signals transmitted from all of the smoke detectors forming an AND combination. The smoke detectors forming said AND combination are manually designated by the instruction at the input device provided on the receiver. The other is the introduction of priority fire alarm means which cooperates with more than two of said smoke detectors forming an AND/OR combination in which one or more of the smoke detectors are designated as superior ones and others are designated as inferior ones. Said priority fire alarm means causes the alarm means to issue the alarm signal preferentially for the superior smoke detectors and secondarily for inferior smoke detectors. That is, the alarm signal is issued when said fire judging means determines fire presence either for the smoke density signal transmitted from any one of superior smoke detectors or for the respective smoke density signals transmitted from all of said inferior smoke detectors. The superior and inferior smoke detectors can be designated by instructions at the input device on the receiver. With this arrangement, the system can acknowledge the preference of the smoke detectors and their locations in fire detection and therefore can be well adapted for the use to monitor the locations or rooms of different conditions simply by manipulating the input device.

It is therefore a further object of the present invention to provide a fire alarm system which can be flexibly adapted to the actual situations in an effective manner as to detect the presence of fires.

Other advantageous features of the present invention contemplates self-compensating capacity of the smoke detectors employed in the system. The smoke detectors in the system are of photoelectric type comprising a light source and a photo-sensor defining therebetween a path for smoke particles so that the photo-sensor produces a corresponding output representative of the amount of smoke particles entered in the light path pass. Accordingly, there can occur undesirable fluctuations of the output due to the deterioration of light source, dust spreading over the light source and/or photo-sensor, and other possible factors. For excluding the above undesirable fluctuations from the consideration in deciding the true smoke density, standard level adjusting means is included in each smoke detector. Based on the acknowledgement that the photo-sensor produces the output at such a level that is equal to a density level representing the amount of the true smoke particles plus an instant zero standard level which is the output of the photo-sensor at the instant condition where there is substantially no smoke particle and should therefore vary with time, said standard level adjusting means is designed to determine and store an initial zero standard level of the output from said photo-sensor and to calculate the difference between the initial zero standard level and the aged zero standard level by comparison therebetween such that it can compensate that difference for allowing the photo-sensor to produce the output at a level representative of the density of true smoke particles each time the detection is made. Consequently, self-compensating capacity or self-adjusting of the output from the smoke sensor can be attained in the smoke sensor to assure reliable detection of fire presence. Also included in each smoke sensor is malfunction detecting means which produces a malfunction signal indicating that the smoke sensor is no longer available when said standard level adjusting means acknowledges that the difference between the initial and aged standard levels exceeds a preselected value, by which the user can promptly attend to repairing or replacing the bad detectors.

These and still other objects of the present invention will be more apparent in the following detailed description of the preferred embodiment when taken in conjunction with the attached drawings.

DETAILED DESCRIPTION OF THE PREFERRED EMBODIMENTS

Figure 1:
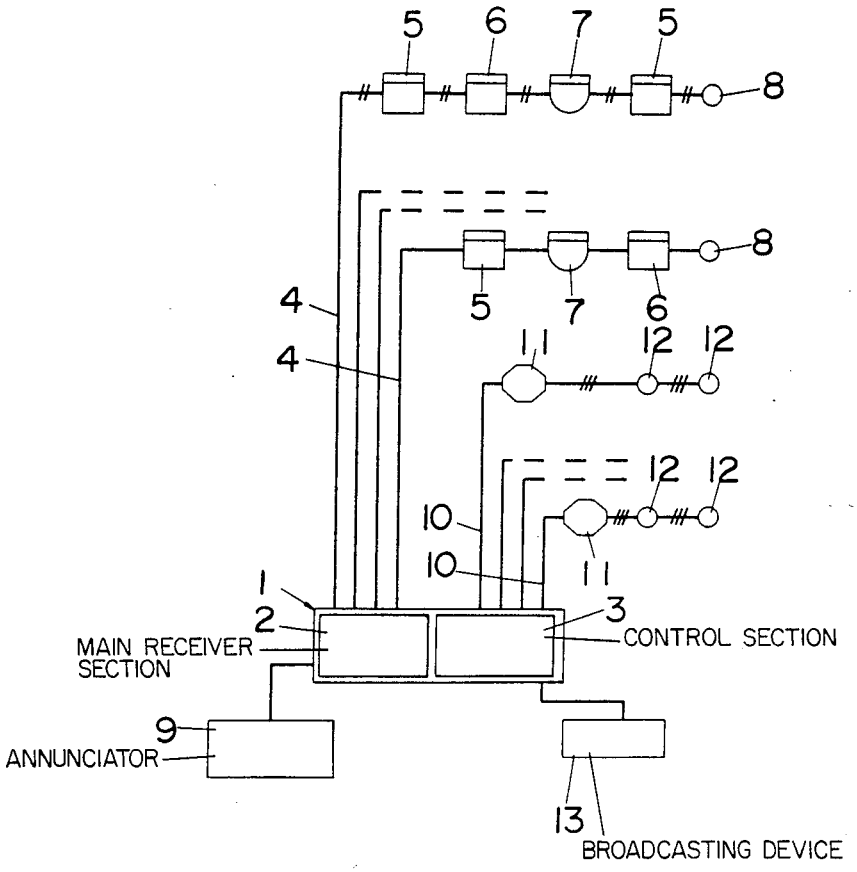
FIG. 1 is a schematic diagram of a fire alarm system embodying the present invention.

Referring now to FIG. 1, there is illustrated a fire alarm system in accordance with a preferred embodiment of the present invention. The system is basically composed of a receiver 1 and a plurality of smoke detectors 5 and 6 connected through data transmission lines 4 to the receiver 1. Said receiver 1 comprises a main receiver section 2 to which are connected the above smoke detectors 5 through said data transmission lines 4 and an interlocking control section 3 to which are connected through control lines 10 to fire prevention equipment 11 and 12 such as fire extinguishers, fire shutters and smoke ejectors. Each data transmission line 4 being composed of two wires and each control line 10 of three wires. Each of said smoke detectors 5 and 6 is of the intelligent type incorporating a processor for transmitting data to the receiver 1. More than one smoke detector of intelligent type can be connected through a single data transmission line 4 to the receiver 1. In the present embodiment, each smoke detector 5 is set to transmit data to the receiver 1 under the control thereof while each smoke detector 6 is set to transmit data to the receiver 1 irrespective of the instruction from the receiver 1. Connected together with the smoke detectors 5 and 6 to each data transmission line 4 is a conventional fire detector 7 which is of circuit-shorting type for sending information to the receiver 1 by shorting the circuit or the lines of the corresponding transmission line 4. These smoke detectors 5 and 6 are installed in different locations or rooms under surveillance while the receiver 1 is installed in a central station. Each of said fire prevention equipment is interlocked or operatively associated with one of said intelligent smoke detectors 5 so as to be actuated when the receiver 1 determines the presence of fire from the data transmitted from the associated smoke detector 5. The procedure of assigning specific intelligent smoke detectors to specific fire prevention equipment can be performed by an operator with an input device such as a keyboard provided on said interlocking control section 3 of the receiver 1. Additionally connected to the receiver 1 are an annunciator 9 to be installed in another station and an emergency broadcasting device 13 which produces a warning message upon the determination of fire presence by the receiver 1. Provided at the end of each data transmission line 4 is a terminating device 8 for checking the interruption of the line 4.

Figure 2:
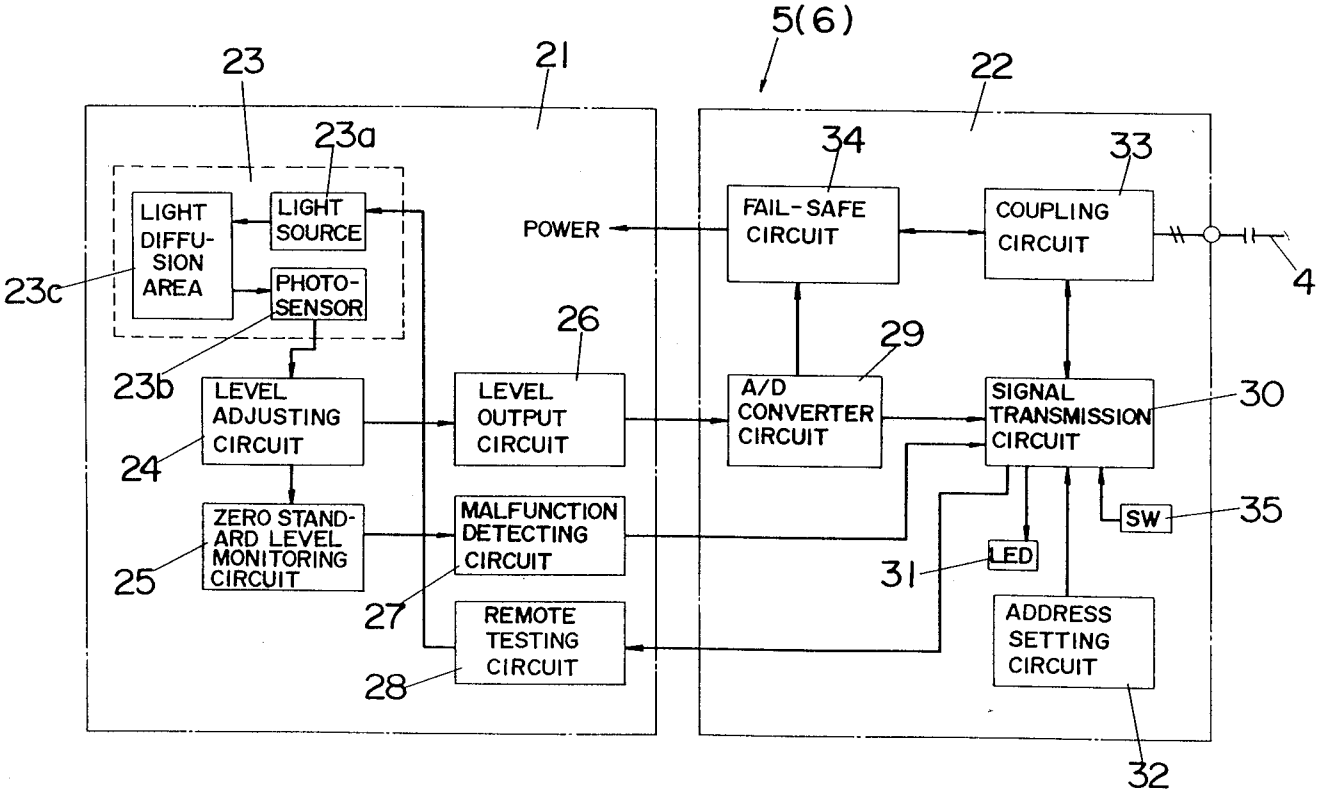
FIG. 2 is a schematic block diagram showing the function of each smoke detector of intelligent type employed in the above system.
Figure 3:
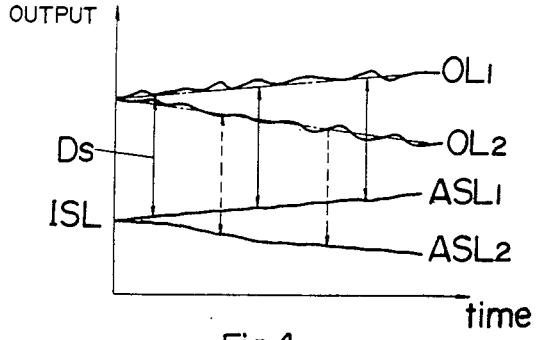
FIG. 3 is an explanatory diagram illustrating the function of a level adjusting circuit provided in said intelligent smoke detector.
Figure 4:
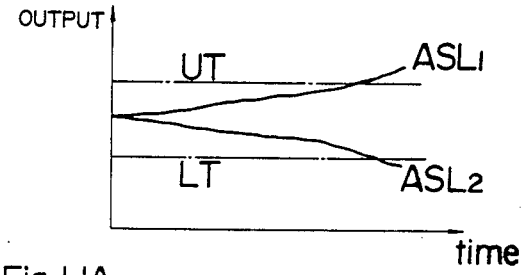
FIG. 4 is an explanatory diagram illustrating the function of a zero standard level monitoring circuit provided in said intelligent smoke detector.

As shown in FIG. 2, each of said intelligent smoke detector 5 and 6 is composed of a smoke detecting unit 21 and a signal processing unit 22 responsible for the intelligent operation. Included in the smoke detecting unit 21 is a combination light source 23*a* and photo-sensor 23*b* which define the smoke detector to be of photoelectric detection type and are disposed within a detecting head 23 defining therein a smoke chamber or light diffusion area 23*c* in which smoke particles are allowed to enter for detection of smoke density. The light from the light source 23*a* is diffused or reflected from the smoke particles present in the smoke chamber 23*c* so as be received in the photo-sensor 23*b* which responds to produce an output representative of the amount of smoke particles or smoke density. The output from the photo-sensor 23*b* is fed through a level adjusting circuit 24 where it is processed to correctly represent true smoke density. The output of the level adjusting circuit 23*b* is fed to said signal processing unit 22 through a level output circuit 26. Said level adjusting circuit 24 is for offsetting undesirable fluctuation of the output level from the photo-sensor 23*b* which may result from the deterioration of the light source 23*a* and photo-sensor 23*b*, and other possible factors such as dust in the photoelectric system. For this purpose, said level adjusting circuit 24 stores an initial zero standard level which is the output level from the photo-sensor 23*b* at the initial condition where there is no substantial smoke particle and reads an aged zero standard level which is the output level from the same at an aged condition where there are no substantial number of smoke particles in order to obtain the difference between the initial and aged zero standard levels. This difference, which is the cause of said undesirable fluctuation, can be cancelled in the same level adjusting circuit 24 so that the circuit 24 produces the output representative of true smoke density irrespective of the deterioration or aging of the photoelectric system. That is, as shown in FIG. 3, the aged zero standard level indicated at $ASL_1$ or $ASL_2$ will vary over a long time period to have a serious level difference from the initial zero standard level indicated at ISL, so that the corresponding output indicated at $OL_1$ and $OL_2$ will vary to mislead the smoke density detection without said offset or compensation for the undesirable fluctuation. In other words, the difference indicated at $D_S$ in the same figure correctly represents the information of true smoke density and it is this information that is fed to said signal processing unit 22 as the output from the level adjusting circuit 24. Instead of the above level compensation, a feedback control scheme may be utilized to adjust the the zero standard level to a fixed value by controlling the amount of light from the light source 23*a*. Associated with said level adjusting circuit 24 is a malfunction detecting circuit 27 which issues a warning signal when a zero standard level monitoring circuit 25 sees that said aged zero standard level $ASL_1$ or $ASL_2$ exceeds an upper threshold value UT or falls below a lower threshold value LT, as shown in FIG. 4, so as to result in a significant difference between the initial and aged zero standard levels to such an extent that the said level adjusting circuit 24 can no longer compensate for that difference. The warning signal is processed in the signal processing unit 22 to be transmitted through the data transmission line 4 to the receiver 1, warning the personnel in charge of the fire alarm system of the fact that the smoke detector 5 transmitting such warning signal is no longer available and should be repaired or replaced. Additionally, a remote testing circuit 28 is provided in the smoke detecting unit 21 for testing the operation of said photoelectric system in response to the instruction from the receiver 1. When the remote testing circuit 28 receives the instruction from the receiver 1 through a signal transmission circuit 30 in the signal processing unit 22, it enables the light source 23*a* to emit a more intense light in order that the photo-sensor 23*b* can receive the equivalent light to that reflected by a considerable amount of smoke particles, whereby the smoke detector 5 presents and transmits the smoke density signal indicating the significant smoke density to the receiver 1 for checking the operation of the system. At this occurrence, a LED 31 provided in the signal processing unit 22 is turned on and monitored by the person in charge.

In said signal processing unit 22, an analog-digital converter circuit 29 receives the output from said level adjusting circuit 24 through the level output circuit 26 to provide a digital signal indicating the smoke density in several discrete levels. In the present embodiment, the analog-digital circuit 29 has three predetermined reference levels respectively corresponding to 5%, 10% and 15% of smoke density. For example, the level of the output from the level adjusting circuit 24 can be classified into four subranges defined by the three reference levels to indicate the smoke density level in four subranges. The digital signal is then fed to the signal transmission circuit 30 which responds to transmit the digital signal as a smoke density signal to the receiver 1 through a coupling circuit 33 and the data transmission line 4 each time the receiver 1 call for the smoke detector 5. Also included in the signal processing unit 22 is a fail-safe circuit 34 which sends the information of fire presence by connecting a low impedance to the data transmission line 4 of two wires rather than by said smoke density signal through the coupling circuit 33 when said analog-digital converter circuit 29 receives from the smoke detecting unit 21 the data indicating that a higher smoke density lasts over a critical time period. This is advantageous in the case when the signal transmission circuit 30 formed by a CPU should fail to transmit the smoke density signal to the receiver 1. An address setting circuit 32 is included in the signal processing unit 22 to provide a specific address to each smoke detector 5 or 6. A selection switch 35 is coupled to the signal transmission circuit 30 so as to render the smoke detector of the above construction not to respond to the signal from the receiver 1 (to be smoke detector designated by the numeral 6) but to send the address signal to the receiver 1 when switched into one position, otherwise the smoke detector holds the above mentioned functions (to be smoke detector designated by the numeral 5). It is to be noted that each of the smoke detectors 5 and 6 derives its power from the receiver 1 through the corresponding data transmission line 4.

Figure 5:
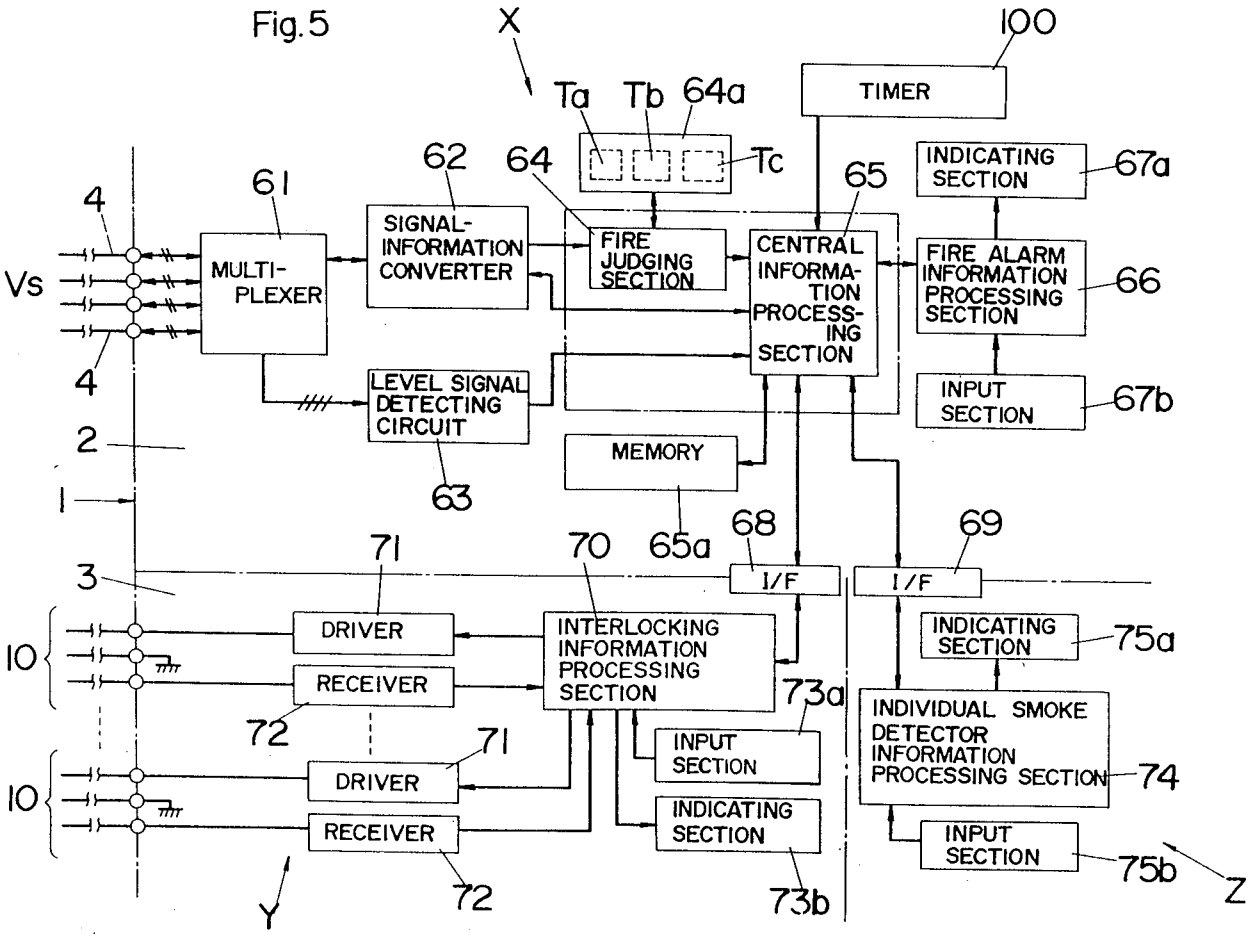
FIG. 5 is a schematic block diagram showing the function of a receiver employed in the above system.
Figure 6:
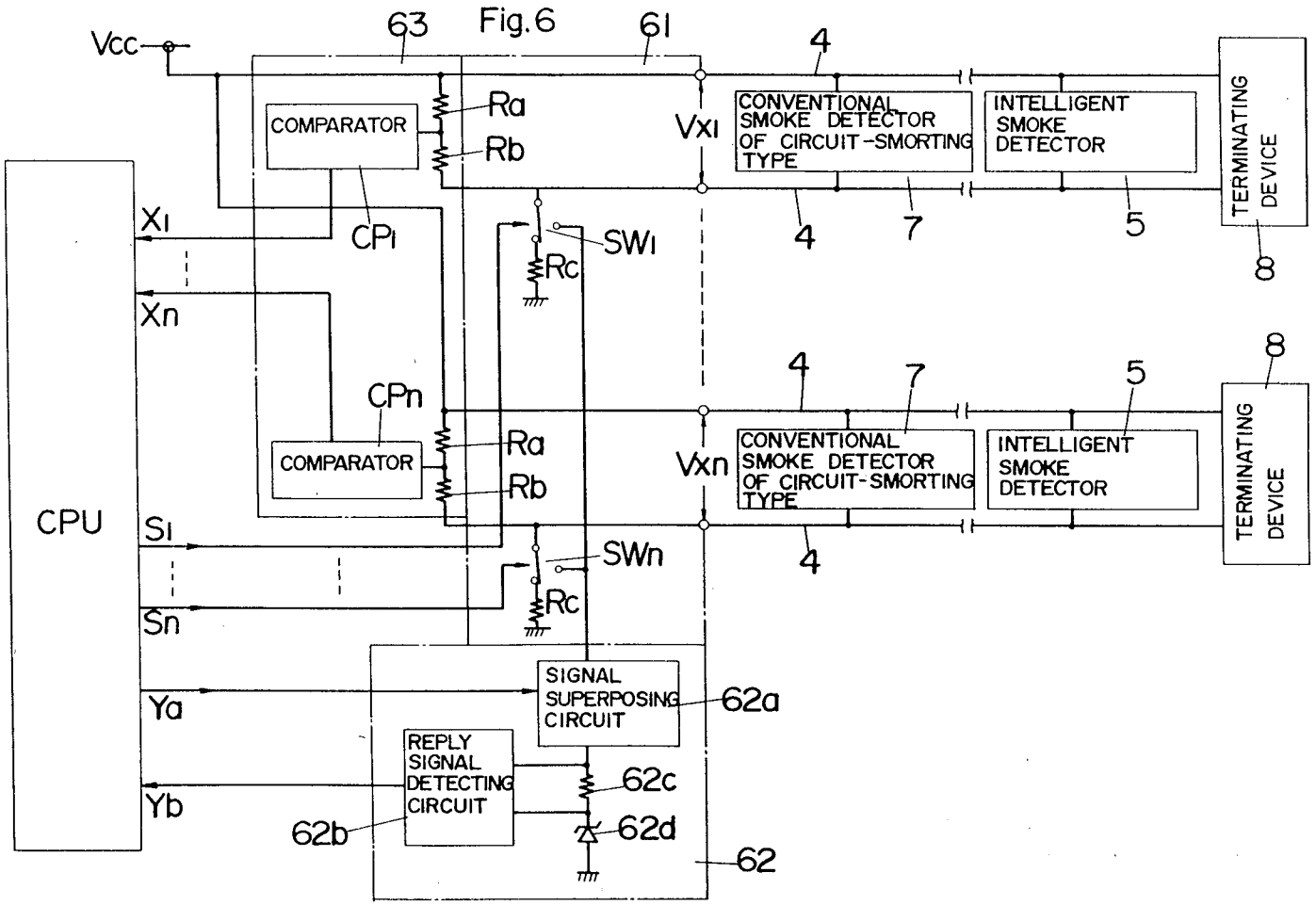
FIG. 6 is a schematic diagram in somewhat concrete representation of the part of the above receiver.
Figure 7:
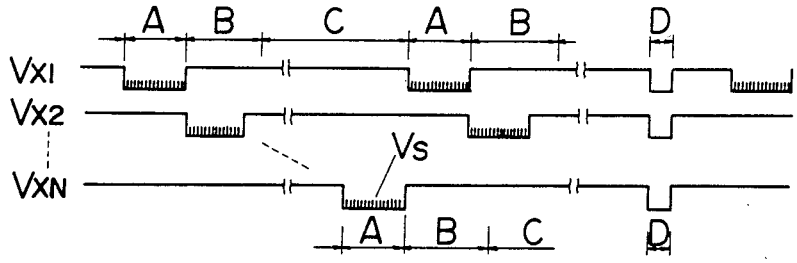
FIG. 7 is a chart illustrating waveforms carried on a data transmission line between the receiver and the smoke detectors in the above system.
Figure 8:
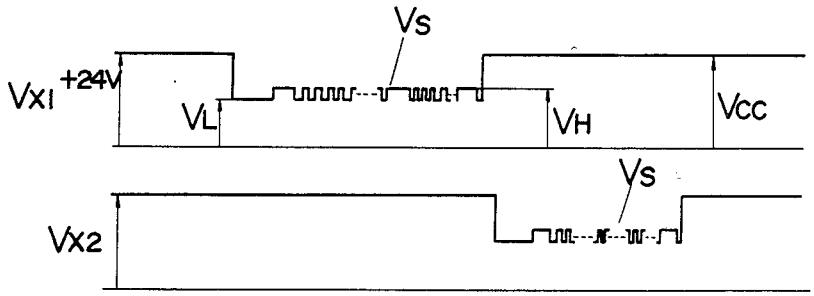
FIG. 8 is an enlarged waveform chart illustrating the details of FIG. 7.
Figure 9:
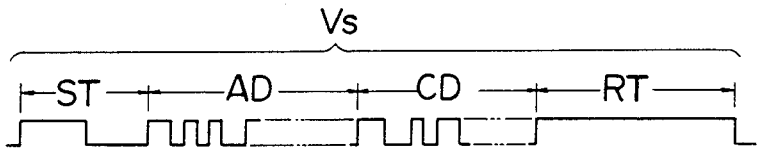
FIG. 9 is a waveform chart illustrating the signals in one sequence between the receiver and each smoke detector.
Figure 10A:
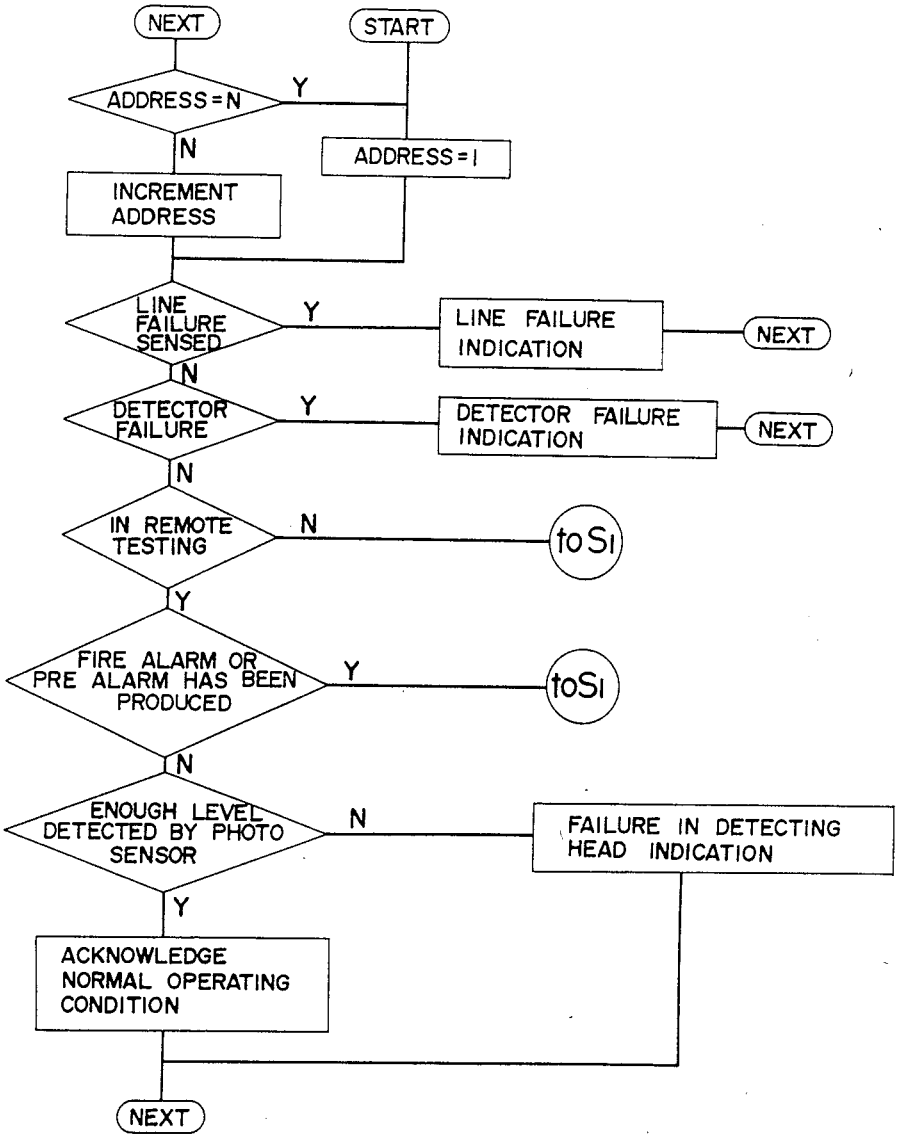
FIG. 10, composed of FIGS. 10A to 10E, shows a flow diagram illustrating the operational sequence of the above system.
Figure 10B:
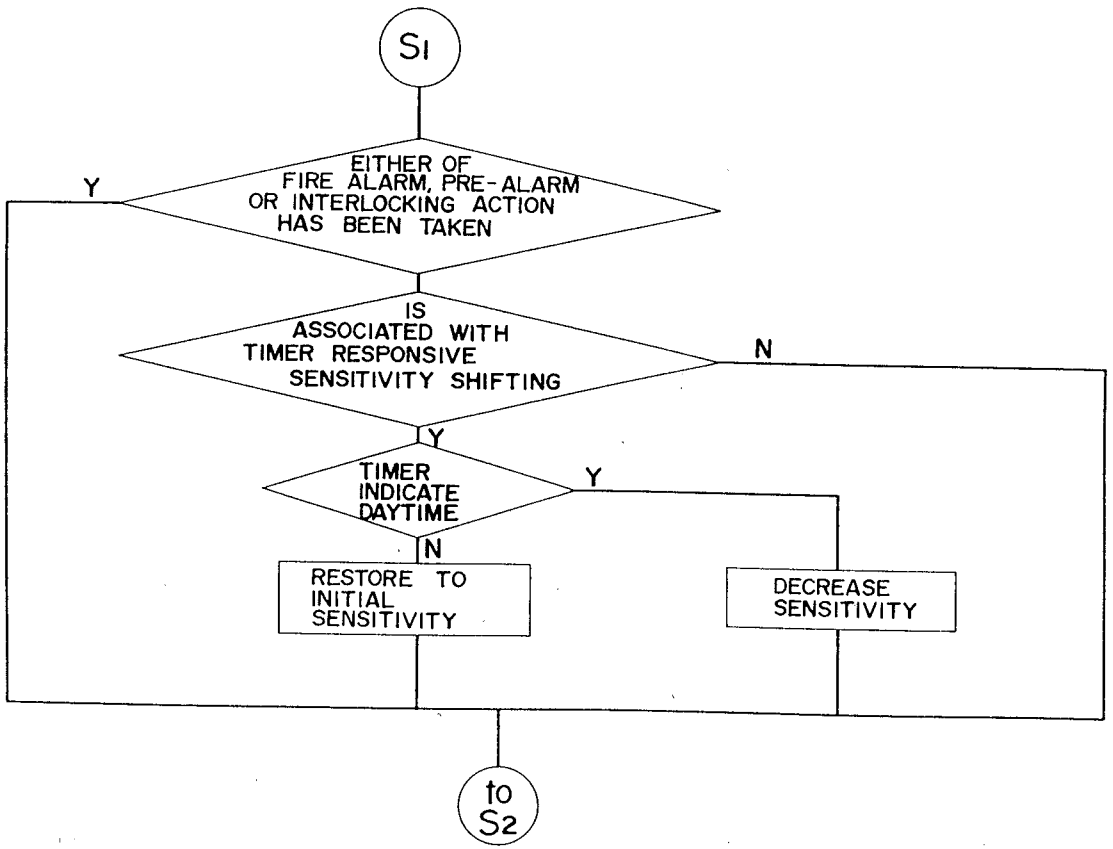
Figure 10C:
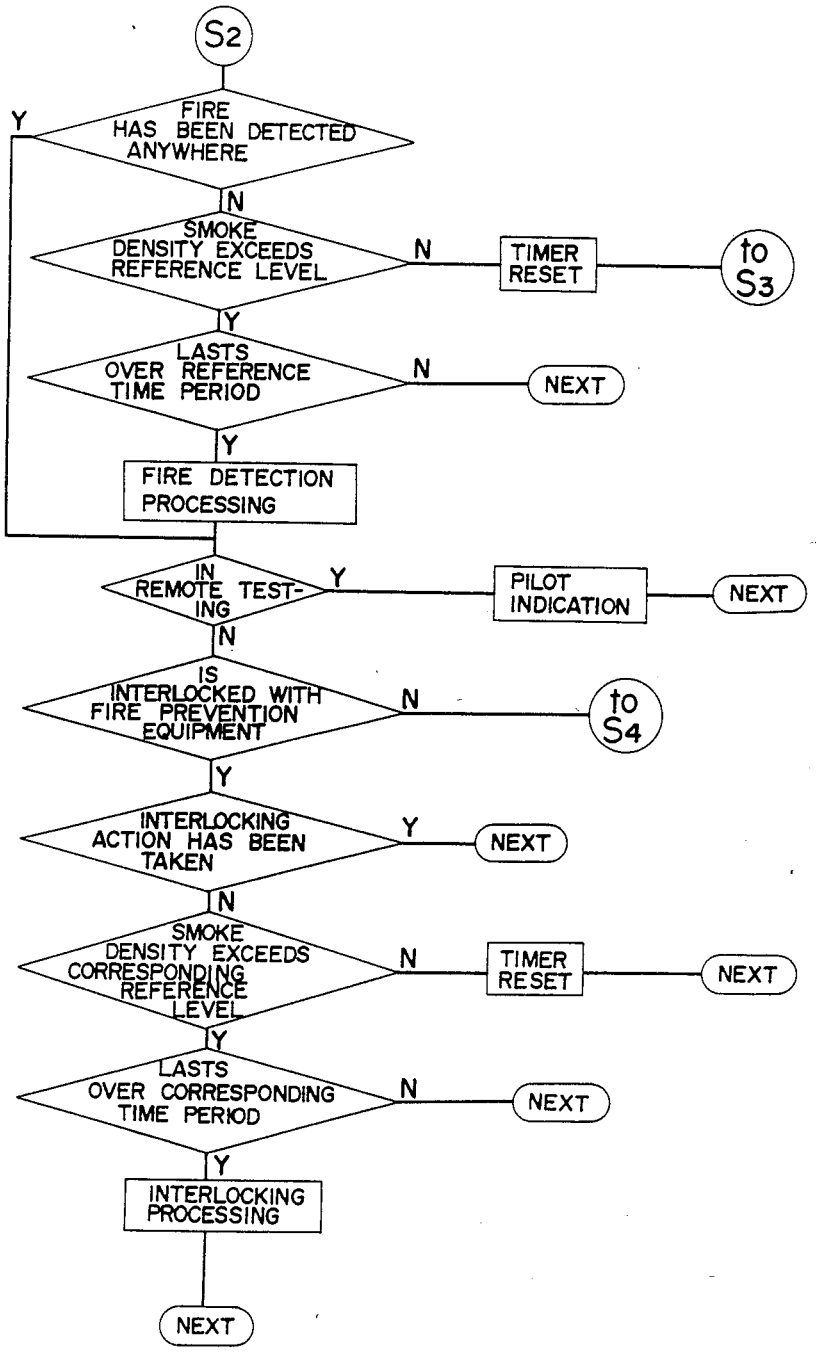
Figure 10D:
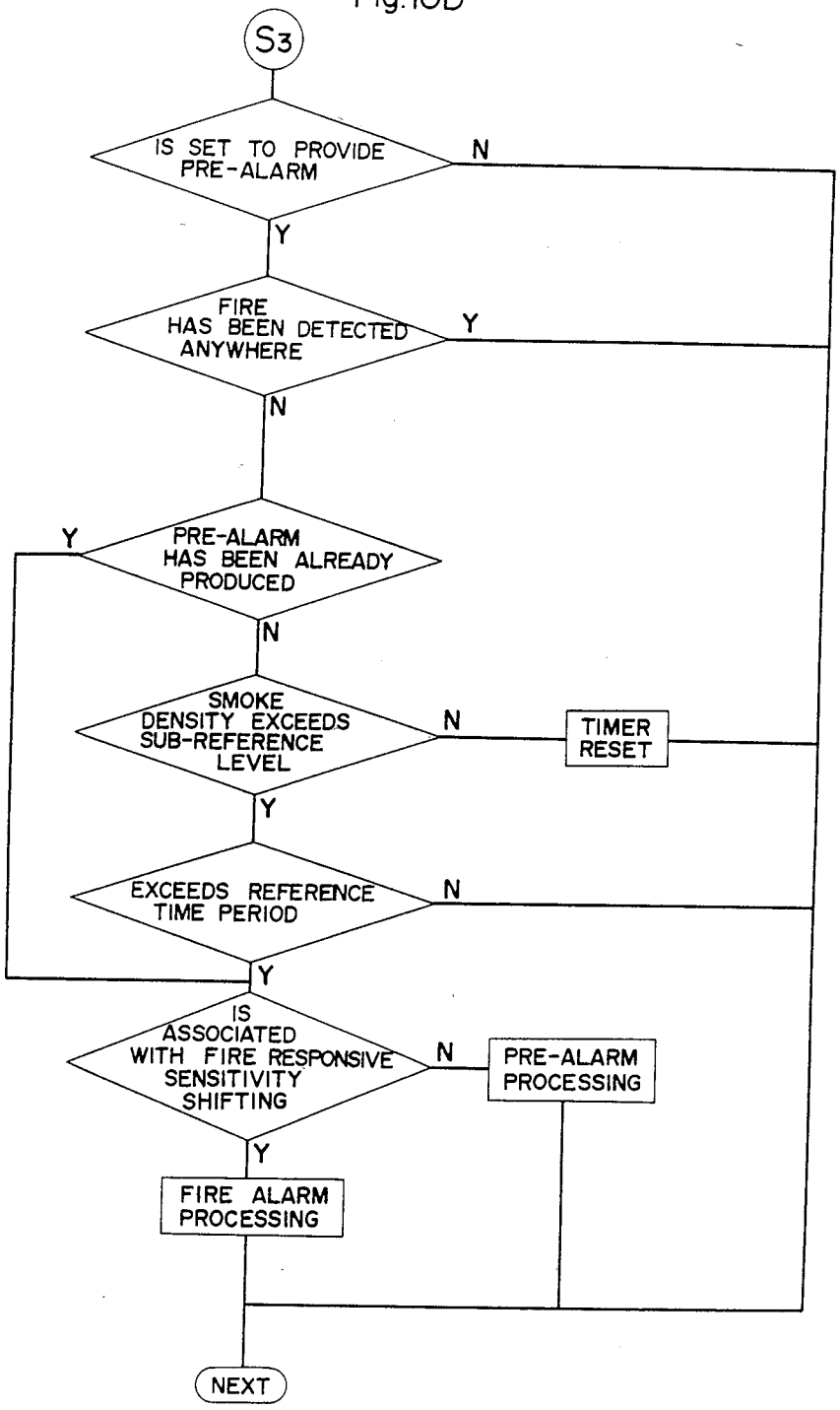
Figure 10E:
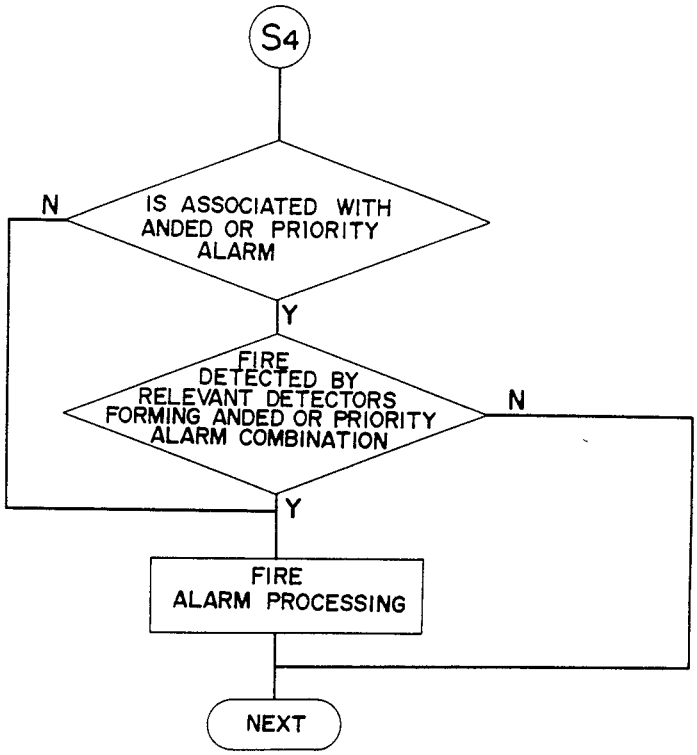

Now referring to FIGS. 5 and 6, the functional arrangement of said receiver 1 is shown for easy understanding of the operation of said receiver 1. The receiver can be separated into three functional divisions, one indicated at X of FIG. 5 for a fire judging division, another indicated at Y for an interlocking division and the other indicated at Z for an information setting division. The functions of the fire judging division X will now be discussed with reference to FIGS. 5 and 6 in which conventional fire detectors 7 of circuit shorting type along with the smoke detectors 5 of intelligent type are connected to the receiver 1. The receiver 1 provides line voltages $Vx_1$ to $Vx_n$ in the waveforms as shown in FIG. 7 for respective data transmission lines 4 on which the above two types of the smoke detectors are carried. These line voltages are respectively divided with respect to time series into sets of signal transmission band <A>, line examination band <B> and supervisory band <C>, each set repeating cyclically. In each signal transmission band <A>, groups of transmission signals Vs are superposed on a reduced line voltage, as shown in FIG. 8, for polling all the intelligent smoke detectors 5 on the common data transmission line 4. In each line examination band <B>, the above fire judging division X of the receiver 1 checks whether or not the corresponding transmission line 4 is interrupted by the help of said terminating device 8 provided at the end of the transmission line 4. That is, the terminating device 8 responds to decrease its impedance across the transmission line 4 in this line examination band <B> such that the increment of current increase in this band can be measured for determination of the interruption of the transmission line 4. It is within the supervisory bands <C> that the fire judging division X acknowledges the operations of the conventional fire detectors 7 by supervising the current level appearing on the corresponding data transmission lines 4. That is, when the conventional fire detector 7 detects the presence of fire to short the line 4 on which it is connected, the resulting increase in current flowing therein is detected by a level signal detecting circuit 63 of the fire judging division X. A plurality of comparators $CP_1$ to $CP_n$, as shown in FIG. 6, are responsible for this detection of the current increase in the respective transmission lines 4. At this occurrence, a central information processing section 65 coupled to the circuit 63 will respond to provide an alarm indicating the presence of fire at any one of the conventional fire detectors on the particular transmission line 4, such alarm being processed at a fire alarm information processing section 66 to actuate an indicating section 67*a* for providing an alarm sound, lighting, or other indication. In the meanwhile, each group of said transmission signals Vs superposed on the line voltage Vx in the signal transmission band <A> is composed of a start signal ST, an address signal AD and a control signal CD accompanying a reply waiting duration RT. During duration RT, the corresponding intelligent smoke detector 5 responds to the control signal CD for transmitting a reply signal to the fire judging division X of the receiver 1, as best shown in FIG. 9, said start signal ST, address signal AD, control signal CD and reply signal being arranged as time divided in series. It is this reply signal that defines said smoke density signal which is, in the present embodiment, representative of the smoke density at four discrete levels, say, below 5%, between 5–10%, between 10–15%, or above 15% of smoke density.

Said signals Vs including the reply signals are transmitted through a multiplexer 61 and the data transmission lines 4 between a signal-information converter 62 and the respective intelligent smoke detectors 5 under the control of said central information processing section 65. The reply signal or the smoke density signal from each smoke detectors 5 is then fed to a fire judging section 64 where it is related with time for reliable determination of fire presence. That is, the fire judging section 64 is designed to identify fire presence when the smoke density exceeds a reference density level and at the same time when such smoke density lasts over a reference time period. Said reference time period is selected among more than one predetermined time periods such that the sensitivity of the system against the fire presence can be set to be the combined function of the smoke density and the time period. In the present embodiment, said reference time period is set selectively to be 6 seconds or 30 seconds. Accordingly, the sensitivity can be adjusted in eight stages (four stages of smoke densities x two stages of time periods). For this purpose, a timer unit 64*a* is operatively connected to the fire judging section 64. This sensitivity should vary with the smoke detectors installed in different locations and the adjustment of the sensitivity can be easily conducted by an operator, the details of which will be discussed later. When the fire judging section 64 identifies the presence of fire on the basis of a suitably selected sensitivity, it provides a corresponding output to said central information processing section 65, which in turn produces an alarm signal representative of fire presence as well as fire location to said fire alarm information processing section 66. At this occurrence, the section 66 causes the indicating section 67*a* to indicate such information. An input section 67*b* is connected through the fire alarm information section 66 to the central information processing section 65 for the purpose of checking the operation of the fire judging division X as by conducting said remote testing of each smoke detector 5. Said fire judging section 64 and the central information processing section 65 are incorporated in a central processing unit (CPU) indicated in FIG. 6. It is understood from this figure that said multiplexor 61 includes a plurality of switching elements $SW_1$ to $SW_n$ provided in corresponding numbers to said data transmission lines 4 and actuated under the control of CPU. Also known from the figure, said signal information converter 62 includes a signal superposing circuit 62*a* and a reply signal detecting circuit 62*b* through which said smoke density or reply signals from the respective smoke detectors 5 are fed to CPU or fire judging section 64.

Referring back to FIG. 5, said interlocking division Y comprises an interlocking information processing section 70 connected through an interface 68 to said central information processing section 65, pairs of drivers 71 and receivers 72 both interconnected between the interlocking information processing section 70 and the respective control lines 10. Each driver 71 is arranged to actuate the corresponding fire prevention equipments 11 and 12 in response to the instruction from the interlocking information processing section 70 and each receiver 72 is arranged to monitor the conditions of the equipment so as to inform the processing section 70 of their conditions. Such instruction to each drivers 71 is made when the central information processing section 65 identifies the presence of fire with regard to the smoke density signals from the particular smoke detector or detectors 5 related to the fire prevention equipment to be actuated. The relation between the particular smoke detector or detectors 5 and the equipment can be arbitrarily established at an input section 73*a* by the operator. That is, the operation of assigning specific smoke detectors to the fire prevention equipment is performed by the use of a keyboard as said input section 73*b* and such combination of the smoke detectors and the equipments are stored in the interlocking information processing section 70. An indicating section 73*b* is coupled to the section 70 for display of the operating conditions of the fire prevention equipment.

Included in said information setting division Z of the receiver 1 is an individual smoke detector information processing section 74 which is connected through an interface 69 to said central information processing section 65 so as to be associated therewith for handling the individual information with regard to the respective smoke detectors 5. Such individual information includes the afore-mentioned sensitivity of the system for each smoke detector 5, and functional combinations of the smoke detectors the details of which will be explained hereinafter with reference to the operation of the system. The above information setting is carried at an input section 75*b* comprising a keyboard and the keyboarded information is stored in the information processing section 74. An indicating section 75*b* is connected to the section 74 for displaying relevant information as to the above individual information.

Accordingly, the system allows the keyboard entry for setting individual sensitivity which is the combined function of the smoke density and the time for each smoke detector 5 in locations of different conditions, such that reliable identification of fire presence depending upon the actual conditions of use can be obtained. The manner in which the present system identifies or judges the presence of fires for the smoke density signal transmitted from one smoke detector 5 will be now explained with reference to FIGS. 11A to 11D. The above sensitivity is determined by selecting a reference smoke density level among said predetermined density levels $L_1$, $L_2$ and $L_3$ respectively corresponding to 5%, 10% and 15% of smoke density, as indicated in these figures, and by selecting a reference time period between said predetermined time periods, say, 6 seconds and 30 seconds. In these figures, said reference density level is set to be the second level $L_2$, for example. Prior to proceeding with the explanation of the fire judging scheme, it is noted that the system is also provided with pre-alarm means for issuing a pre-alarm signal representative of possible fire presence. The pre-alarm means is arranged to issue the pre-alarm signal either when selected one of the smoke detectors detects a smoke density above a sub-reference smoke density which is lower than said reference smoke density and at the same time such smoke density lasts over a predetermined time period, or when the time periods in each of which the smoke density detected by the same exceeds said reference smoke density total more than a predetermined value. This function of issuing the pre-alarm signal can be selectively assigned to specific smoke detectors also by the use of said keyboard. In the present system, said sub-reference smoke density is automatically set to be lowered by one level, i.e., to be the first level $L_1$ in the figures.

Figure 11A:
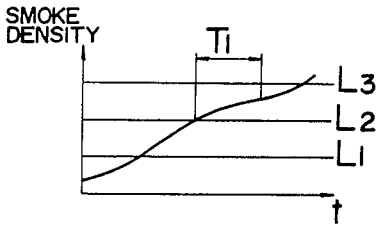
FIG. 11A to 11D are explanatory views respectively illustrating how the determination of fire presence is made with the above system.
Figure 11C:
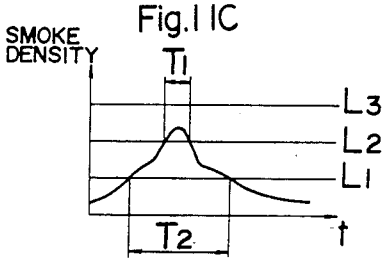
Figure 11B:
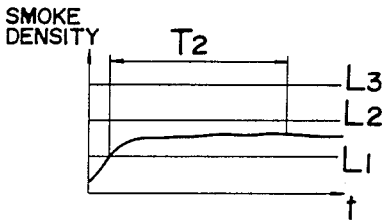
Figure 11D:
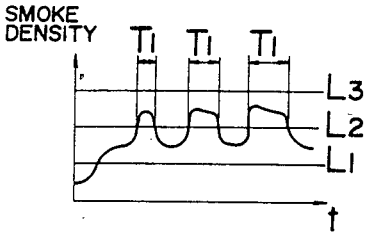

In operation, when the smoke density detected by the smoke density represented by the smoke density signal first exceeds the above the reference density $L_2$, as shown in FIG. 11A, a first timer Ta in the timer unit 64*a* of FIG. 6 starts counting until the smoke density falls below the reference level $L_2$ so as to calculate the time period $T_1$ over which the smoke density last at a level above the reference level $L_2$. This time period $T_1$ is compared with the reference time period at said fire judging section 64 such that it identifies the presence of fire and produces the alarm signal only when the former exceeds the latter. FIG. 11B shows the condition where the smoke density exceeds the sub-reference level $L_1$ but is below the reference level $L_2$, and it remains to be between these levels $L_1$ and $L_2$ for a longer time. At this condition, a second timer Tb in said timer unit 64*a* counts the time period $T_2$ over which the smoke density above the sub-reference level $L_1$ lasts. The time period $T_2$ thus counted is compared with a predetermined time period at said fire judging section 64 in the like manner as to provide said pre-alarm signal when the former exceeds the latter. In contrast to the above, when both the consecutive time period $T_1$ in which the smoke density goes above the reference level $L_2$ and the consecutive time period $T_2$ in which the smoke density goes above the sub-reference level $L_1$ are relatively short, as shown in FIG. 11C, and are found to be less than the respective reference time periods, the fire judging section 64 will judge that there is no fire presence. Such fluctuation of smoke density would be possible due to uncertain causes even in the absence of fires. As shown in FIG. 11D, when the smoke density varies in such a way as to repeatedly rise up and fall below the the reference level $L_2$ in a relatively short time duration, the first timer Ta counts each time period $T_1$ over which the smoke density is at the level above the reference level $L_2$ for providing the total of the time periods. Then, the total time period is compared with a predetermined value such that the fire judging section 64 provides the pre-alarm signal when the former exceeds the latter. This is an important and advantageous feature of the present system, since such behavior of the smoke density will be frequently seen in the outbreak of the fire.

The above operation and the following unique operations of the present system are carried out in a programmed manner in accordance with programs stored in CPU and in combination with keyboarded instructions by the operator. A flow diagram for an exemplary operating sequence of the present system is shown in FIG. 10, composed of FIGS. 10A to 10E, for easy understanding of the present invention. One of the advantageous functions effectuated by the present system is a fire responsive sensitivity shifting sequence, which serves to increase the sensitivity of the system to fires once the fire presence is identified at any one of the discrete locations for early detection of the progress and spread of fires, by which rapid fire fighting can be available. The CPU in said fire judging division X of the receiver 1 is responsible for that operation and responds to execute a programmed sequence when said fire judging section 64 identifies the presence of fire at any one of the selected smoke detectors 5 forming an arbitrary group, that is when the combined information of smoke density sent from any one of the smoke detectors 5 in different locations and the corresponding time period is determined be representative of fire presence at the fire judging section 64. At the occurrence, the respective sensitivities of the system against fires with respect to the other smoke detectors 5 in the other locations are automatically increased by shifting either or both of the reference smoke density level and reference time period for each of the smoke density signals from the smoke detectors in said group. Consequently, the system can be ready for accurately following the spread of fires so as to allow the personnel to promptly take steps for checking the spread of fires and to maintain the damage at a minimum. The designation of said group of smoke detectors can be made by the keyboarded entry at said input section **75*b* of the information setting division Z of the receiver 1**.

A 24-hour timer 100 is incorporated in the present system for shifting the sensitivity of the system against fires in the selected locations where the conditions may differ with daytime and nightime. For this purpose, a timer responsive sensitivity shifting sequence is introduced to be executed in response to the timer 100. The shifting of the sensitivity is found to be useful and should be rather necessary in view of the fact that certain location or rooms among the locations under surveillance by the smoke detectors 5 will subject to considerable change in the smoke density level between the daytime and the nighttime. That is, rooms where there is frequent smoking or the use of cooking appliances should have the smoke detectors the sensitivity of which is higher at night than in daytime for preventing false detection of fire due to the smoking and the like in daytime, while for providing an early and reliable detection of fire in nighttime. In accordance with the timer responsive sensitivity shifting sequence, the CPU instructs said fire judging section 64 to increase the sensitivity of the system with respect to each of the selected smoke detectors 5 by shifting either or both of the reference density level and the reference time period in response to the output of the timer 100 indicating the beginning of the nighttime, and to decrease the sensitivity in response to the output of the timer 100 informing the beginning of daytime. In the present invention, the 24-hour timer 100 is utilized to account for the different conditions of the location from in daytime and in nighttime in the sense of discriminating the condition of the location when people are present from when people are absent. Therefore, a human detector or other devices capable of discriminating the above difference may be utilized instead of the 24-hour timer 100.

As described previously, the fire prevention equipments 11 and 12 are interlocked with the receiver 1 so that they are actuated when the fire judging section 64 identifies the presence of fire based on the information from the related or associated smoke detectors 5. The CPU acknowledges the interrelation determined at the input section **75*b* by the operator between the specific smoke detectors 5 and the specific fire prevention equipments 11 and 12, such that the operation sequence of the present system cares for the automated actuation of the fire prevention equipment 11 and 12**.

In the present system, several smoke detectors 5 can be combined optionally into an interrelated family which is termed as an ANDed combination by the keyboarded entry at said input section **75*b* of the receiver 1. The ANDed combination of the smoke detectors 5 is such that said central information processing section 65 produces the alarm signal only when all of the information sent from the respective smoke detectors 5 forming the ANDed combination are judged at the fire judging section 64 to be representative of fire presence. The ANDed combination of the smoke detectors 5 is stored in a memory unit 65*a*** of CPU so that the operating sequence of the system can care for this unique operation.

Also in accordance with the present system, several smoke detectors 5 can be combined optionally into another interrelated family which is termed as an AND-/OR combination composed of more than two smoke detectors 5 and is designated by the keyboarded entry at the same input section **75*b* of the receiver 1. In said AND/OR combination, one or more of the smoke detectors 5 are designated as superior ones, and the others designated as inferior ones. The above combination or interrelation between the smoke detectors 5 is stored in the memory unit 65*a* and acknowledged by the CPU such that the operating sequence care for the above combination, whereby the CPU provides the alarm signal either when said fire judging section 64 identifies the presence of fire based upon the information from any one of the superior smoke detectors 5 or when said fire judging section 64 identifies the presence of fires based upon the information from all of the inferior smoke detectors 5**. By the employment of the above ANDed combination and the AND/OR combination, the present system can be properly adapted to different conditions of use for providing maximum reliability in detection of fires simply by assigning the smoke detectors to the ANDed combination and the AND/OR combination.

Figure 12:
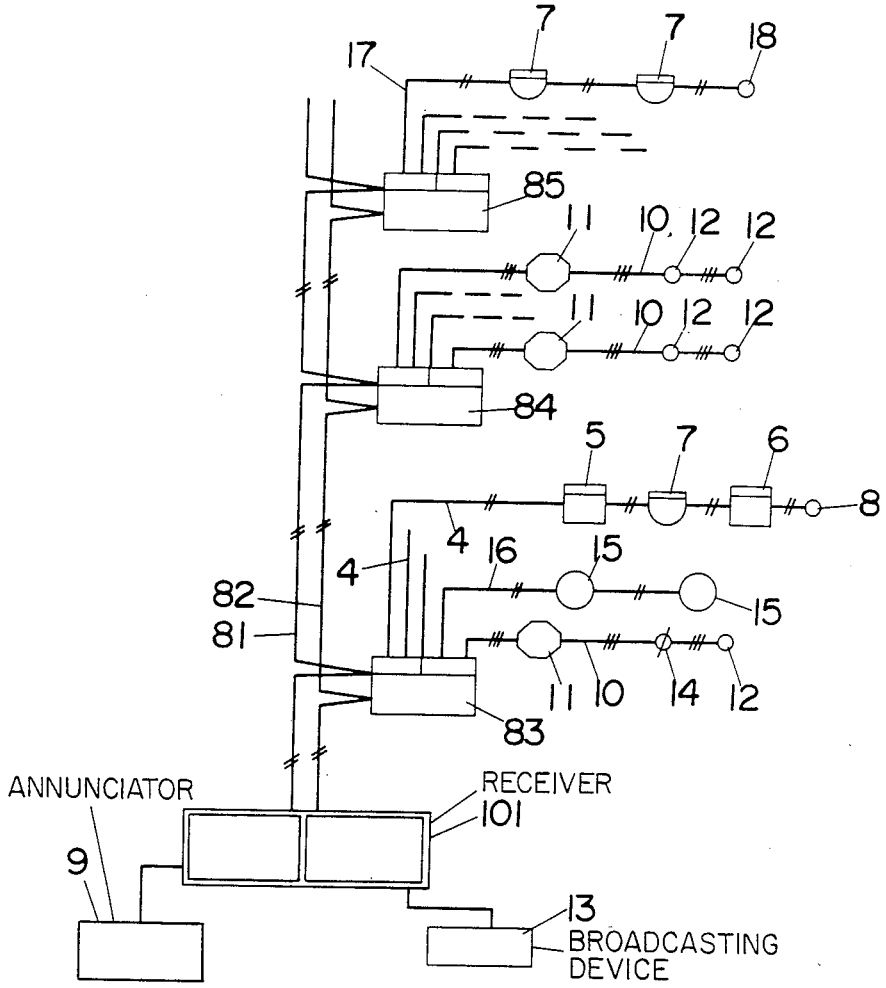
FIG. 12 is a schematic diagram of a fire alarm system in accordance with another embodiment of the present invention.

Referring to FIG. 12, there is shown another preferred embodiment which is substantially similar to the above embodiment except that repeaters 83, 84 and 85 are interposed between the receiver 101 and the respective data transmission lines 4 and 17, and control lines 10. The transmission lines 17 carry the conventional fire detectors 7 alone while the transmission lines 4 carry the intelligent smoke detectors 5 and 6 in combination with the conventional fire detectors 7, and the control transmission line 10 carrying said fire prevention equipment 11 and 12. Each of the repeaters 83, 84 and 85 is connected through a pair of transmission lines 81 and 82 to the receiver 101.

Although the present invention has been described in its preferred embodiments, it should be understood by those skilled in the art that the present invention is not limited to the present embodiments and various changes and modifications may be made without departing the spirit and scope of the present invention.

What is claimed is:

1. A fire alarm system which comprises:

a plurality of smoke detectors adapted to be installed in different locations, each smoke detector measuring the density of possible smoke in corresponding location as analog data and producing a corresponding smoke density digital signal indicative of the smoke density;

a receiver connected through a data transmission line to said smoke detectors so as to receive the individual density signals from the smoke detectors;

fire judging means included in the receiver for determining the presence of fires and fire locations only when the smoke density signal from the smoke detector in the corresponding location exceeds a reference density level and at the same time when such smoke density lasts over a reference time period;

said receiver including selection means for selecting said reference density level among a plurality of predetermined density levels of different values for each smoke detector as well as for selecting said reference time period among a plurality of predetermined time periods of different values for each smoke detector; and alarm means responding to the determination of presence of fire by said judging means for issuing an alarm signal.

2. The fire alarm system as set forth in claim 1, including fire responsive sensitivity shifting means which, upon the determination of fire presence in one location by said fire judging means, automatically increases the sensitivities of the system against the smoke density signals from the smoke detectors in other locations for determination of fire presence at said fire judging means, such sensitivity shifting resulting from the shifting of at least one of the reference density level and reference time period for each of the smoke density signals from the smoke detectors in the other locations.

3. The fire alarm system as set forth in claim 1, including a timer and timer responsive sensitivity shifting means which responds to the input from said timer for varying the sensitivity of the sytem against the smoke density signal transmitted from at least one of the smoke detectors for determination of fire presence at said fire judging means, such sensitivity shifting resulting from the shifting of at least one of the reference density level and reference time period for each smoke density signal from said smoke detectors.

4. The fire alarm system as set forth in claim 1, wherein one or more of the smoke detectors are operatively associated with fire prevention equipment such as fire shutters, fire extinguishers and smoke ejectors each of which is to be actuated upon the determination of fire presence by said fire judging means in the location where the associated smoke detector is installed; and wherein said receiver further includes associate sensitivity shifting means, responsive to the instructions entered at an input device on the receiver designating specific smoke detectors as associated with the fire prevention equipment, for descreasing the sensitivity of the system against the smoke density signal transmitted from each smoke detector associated with said fire prevention equipment relative to that against the smoke density signal transmitted from each smoke detector having no operational relation to the fire prevention equipment.

5. The fire alarm system as set forth in claim 1, further including pre-alarm means for issuing a pre-alarm signal when at least one of (a) the smoke density from any one of the selected smoke detectors exceeds a sub-reference density level which is lower than said reference density level and at the same time such smoke density lasts over a predetermined time period, and (b) when the time periods in each of which said smoke density exceeds said reference level total more than a predetermined value, occurs.

6. The fire alarm system as set forth in claim 1, including ANDed fire alarm means which actuates said alarm means to issue the alarm signal only when said fire judging means determines fire presence for the respective smoke density signals transmitted from all of the smoke detectors forming an AND combination, and the smoke detectors forming said AND combination being designated by the instruction from an input device such as a keyboard provided on the receiver.

7. The fire alarm system as set forth in claim 1, including priority fire alarm means which cooperates with more than two of said smoke detectors forming an AND/OR combination in which at least one smoke detector is designated as a superior one and another of said smoke detectors is designated as an inferior one, said priority fire alarm means actuating said alarm means to issue the alarm signal when said fire judging means determines fire presence by at least (a) the smoke density signal transmitted from any one of the superior smoke detectors and (b) the respective ones of smoke density signals transmitted from all of said inferior smoke detectors, occurs, and said superior and inferior smoke detectors being designated by the instruction entered at said input device.

8. The fire alarm system as set forth in claim 1, wherein each of said smoke detector comprises:

a light source;

a photo-sensor which responds to the amount of light diffused or reflected by the particles of smoke existing in the path between the light source and the photo-sensor for producing an output at such a level that is equal to a density level representing the amount of the true smoke particle plus an instant zero standard level which would be determined at an instant condition where there is supposed to be no substantial smoke particle in said path; and standard level adjusting means for determining and storing an initial zero standard level of the output from said photo-sensor for calculating a difference between the initial zero standard level and the aged zero standard level by comparison therebetween so as to compensate that difference for allowing the photo-sensor and for producing the output at a level representative of density of true smoke particles.

9. The fire alarm system as set forth in claim 8, wherein said smoke detector further includes malfunction detecting means which produce a malfunction signal indicating that the smoke detector is no longer available when said standard level adjusting means indicates that the difference between the initial and aged zero standard levels for that smoke detector exceeds a predetermined value.

10. The fire alarm system as set forth in claim 1, wherein each of the smoke detectors is provided with remote testing means responsive to the instruction from the receiver, for providing an output representative of the smoke density at a level above said reference density level and for transmitting said representative output to the receiver for a time period longer than said reference time period, whereby the receiver can check the operation of the system in such a manner without regard to whether the fire judging means determines the fire presence in response to that output.

* * * * *